US005568921A

United States Patent [19]

Lorentzen et al.

[11] Patent Number: 5,568,921

[45] Date of Patent: Oct. 29, 1996

[54] RACQUET STRINGING MACHINE

[75] Inventors: John F. Lorentzen, El Cajon; Todd B. Colburn, San Diego; Ray Mortvedt, Santee, all of Calif.

[73] Assignee: Ektelon, San Diego, Calif.

[21] Appl. No.: 142,687

[22] Filed: Oct. 26, 1993

[51] Int. Cl.[6] ..... A63B 51/14

[52] U.S. Cl. ..... 273/73 A

[58] Field of Search ..... 273/73 R, 73 A, 273/73 B; 248/161

[56] References Cited

U.S. PATENT DOCUMENTS

| | | | |
|---|---|---|---|
| 2,231,631 | 2/1941 | Maina | 248/161 |
| 2,854,061 | 9/1958 | Romito | 248/161 |
| 4,366,958 | 1/1983 | Bosworth | 273/73 A |
| 4,417,729 | 11/1983 | Morrone | 273/73 A |

FOREIGN PATENT DOCUMENTS

| | | | |
|---|---|---|---|
| 2079612 | 1/1982 | United Kingdom | 273/73 A |

OTHER PUBLICATIONS

Ektelon Model "H" Owner's Manual ©1984. Copy in L 273/73 A.

*Primary Examiner*—Raleigh W. Chiu
*Attorney, Agent, or Firm*—Oldham & Oldham Co., LPA

[57] ABSTRACT

An improved racquet stringing machine having a new table featuring a built-in glide bar groove, an improved string clamp, a new tip riser having integrated, threaded height adjustment, an adjustable throat riser carried by an internal sliding bar having improved position lock, and machine height adjustment by a foot operated mechanism.

16 Claims, 5 Drawing Sheets

RACQUET STRINGING MACHINE

TECHNICAL FIELD

The present invention relates to racquet stringing machines. More particularly, the invention relates to a racquet stringing machine which allows easier, faster, and more accurate stringing of a racquet by means of adjustable tip riser and throat riser assemblies, improved string clamp means and further advantageous characteristics in a contemporary design.

BACKGROUND OF THE INVENTION

Early racquets, whether for playing tennis, racquetball, squash, badminton, etc. were of a similar design. Accordingly, there was little need for versatility in stringing machines to meet the limited differences among the racquets. With the introduction of racquets having significantly different designs such as enlarged heads, throatless racquets, racquets of all shapes and sizes and racquets with various throat designs, it was desirable to have stringing machines that were versatile and able to accommodate a wide variety of racquets. The stringing machine disclosed in U.S. Pat. No. 3,441,275, the string clamp of U.S. Pat. No. 4,874,170, and the improved racquet retaining standard of U.S. Pat. No. 4,546,977 are representative of stringing machines and improvements that were developed to meet the stringing requirements demanded by the new racquets. Now, the present invention presents additional improvements in stringing machines resulting in improved stringing accuracy, consistency and speed.

The improvements in the stringing machine of the present invention, including improved adjustments for the tip riser and throat riser assemblies, a machined groove in the work table to allow proper adjustment of the string clamp, work table height adjustment using a foot activated gas spring, an improved string clamp, and other aspects are nowhere disclosed in the prior art.

SUMMARY OF THE INVENTION

It is the object of the present invention to provide an improved stringing machine which increases racquet stringing speed and improves stringing accuracy.

Another aspect of the present invention is to allow restringing of any size or shape racquet with easier and quicker racquet set up.

An additional aspect of the present invention is that it reduces the possibility of strings getting hung up or snagged on parts of the machine during stringing procedures and reduces possible accidental adjustment of the string tension.

These and other aspects of the present invention are achieved by a racquet stringing machine comprising a base assembly on which a stringing work table is mounted. Throat riser and tip riser assemblies are associated with the table, with the tip riser assembly being vertically adjustable in a manner to allow a racquet to be positively secured in a desired position for stringing. The height adjustment integrated into the tip riser assembly is threaded for smoothness and stability. A horizontally adjustable throat riser assembly includes means to positively fix the position of the assembly for more accurate stringing of a racquet. The throat riser may include an internal sliding bar which provides compactness, greater stability, and faster racquet set up. An improved string clamp provides greater accuracy and better positive engagement to the racquet strings to facilitate stringing. The string clamp is slidably engaged to a glide bar assembly supported on the table and movable within a groove formed in the table to eliminate rails used in the prior art, which required continual realignment. The stringing machine provides a tension head with an improved tamper-proof fairing (or cover) which also avoids the hanging up or snagging of strings during a stringing procedure for more reliable, quicker stringing. An adjustable base and column assembly enables users to raise and lower the table to suit their height.

DETAILED DESCRIPTION OF THE INVENTION

Figure 1:
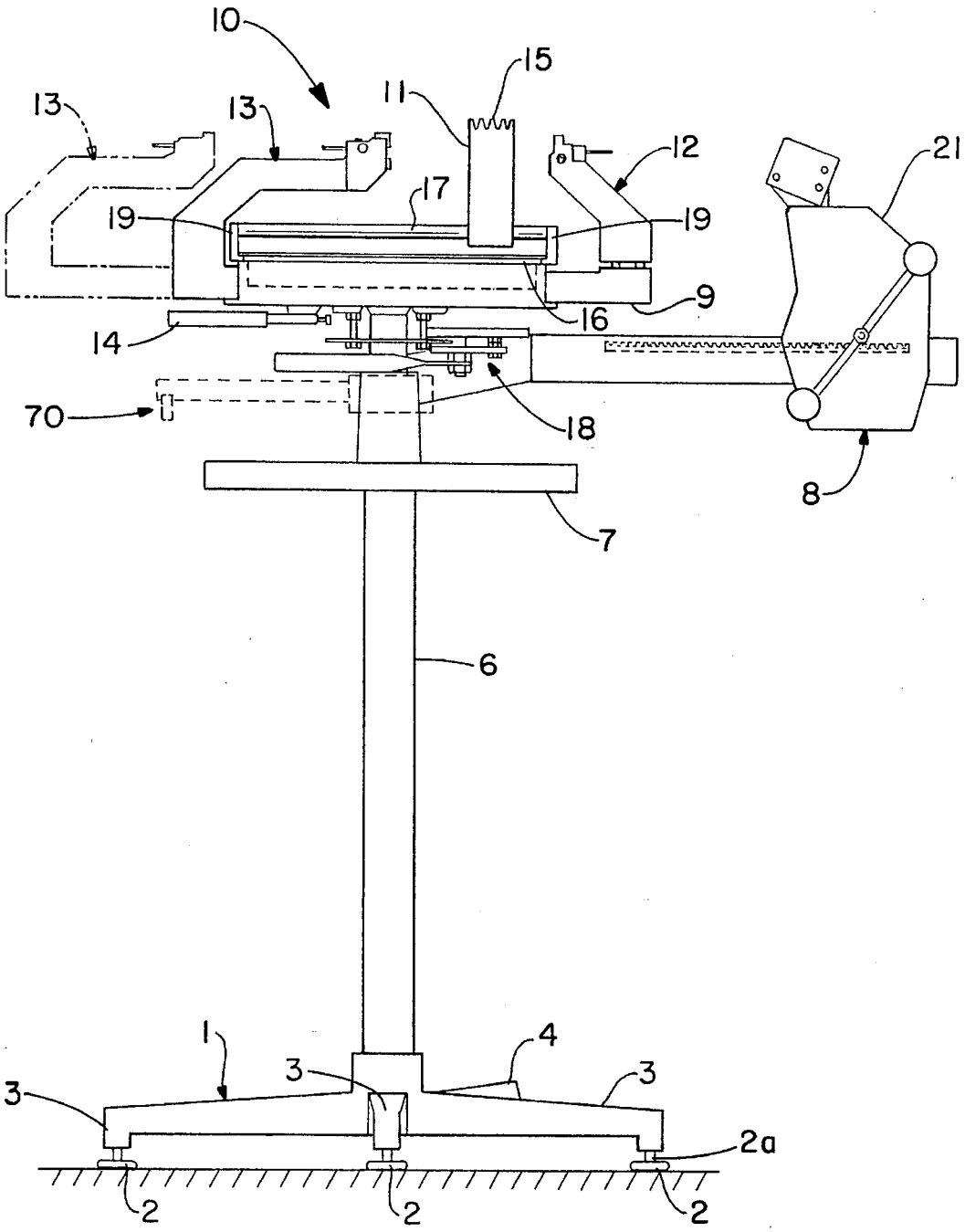
FIG. 1 is a side view of the complete stringing machine.
Figure 2:
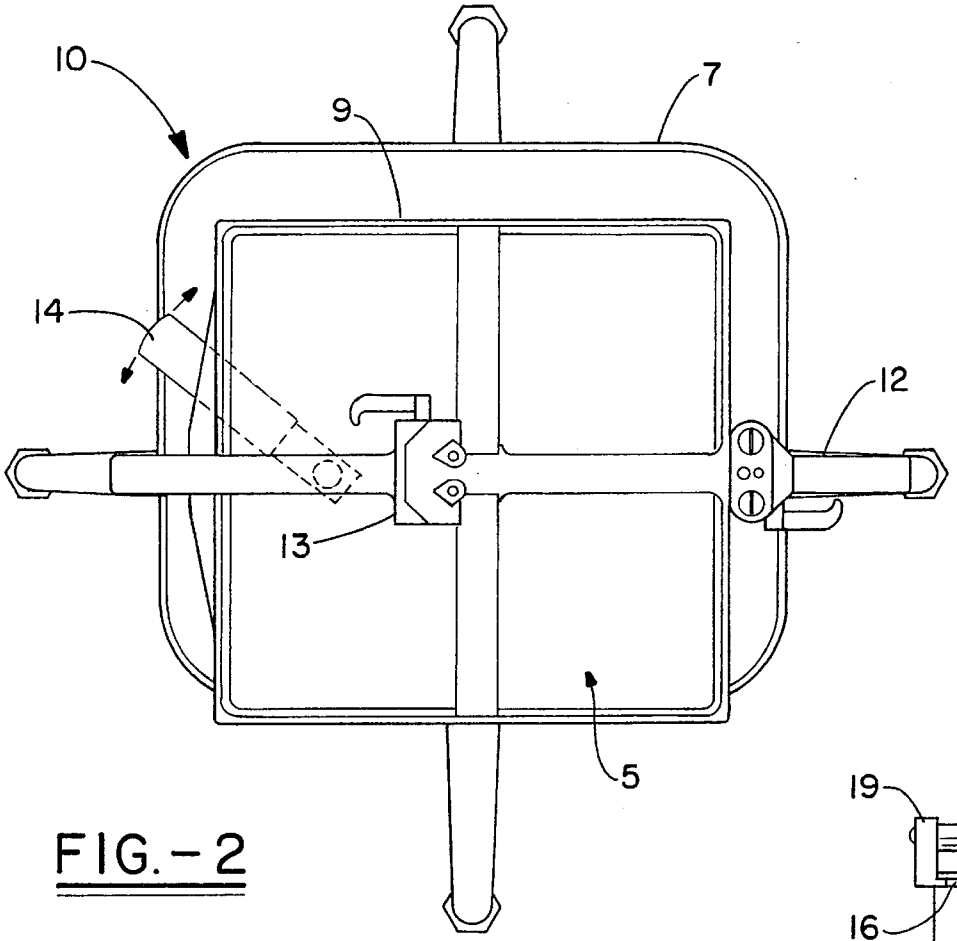
FIG. 2 is a top plan view of the apparatus showing the tip riser, the throat riser, and the table top.

In FIGS. 1 and 2 of the drawings, the racquet stringing machine generally indicated at 10, such as for tennis and racquetball racquets or the like, comprises a base 1 for placement on the floor or other suitable surface. The base 1 may have supporting legs 3 and base leveling pads 2. The leveling pads can be raised and lowered by threaded shafts 2*a* as needed to compensate for uneven surfaces. An upstanding column 6 is integral to or attached to base 1 by conventional means, and provides support for a tension head assembly generally identified by 8, and work table 9. A disc brake 18 may be used to lock the table in a desired position. An optional brake means indicated in ghost at 70 may alternatively be used to lock the table 9 once it is rotated into a desired position. Further, a tool tray 7 may be supported below the work table 9 on column 6. Table 9 is further characterized by tool storage trays as indicated at 5. In addition, the tool storage trays may optionally be covered by a contrasting colored pad to provide improved contrast with strings in the machine 10.

A height adjusting assembly (detailed in FIG. 7) may be contained within column 6, and is actuated to adjust the working height of table 9 by foot-activated pedal 4. When the working height of the table is changed the height of tool tray 7 and tension head 8 are changed to the same degree as the table. That is, the distance between the tool tray and the tension head and distance between the tension head and table remain constant so that their relative positions with respect to each other remain the same.

The table 9 has associated therewith a tip riser assembly generally identified 12, throat riser assembly generally identified by 13, and a glide bar assembly 17. The tip riser assembly 12 provides the means to secure the tip of any conventional racquet therein, while the throat riser 13 will secure the throat of the racquet for restringing. Tip riser assembly 12 is vertically adjustable to accommodate racquet frames having a tapered profile. Throat riser assembly 13 is horizontally adjustable to allow racquets of different head lengths to be secured for stringing. A string clamp assembly 11 is slidably engaged with the glide bar assembly 17 which is engaged with table 9 in machined grooves 16 by means of glide bar supporting frame 19. The mounting of the glide bar assembly by means of grooves 16 allows easy adjustment of clamp assembly 11 across table 9. Some aspects of the string clamp assembly are similar to those described of the in U.S. Pat. No. 4,874,170 which is hereby incorporated herein by reference. The string clamp assembly 11 has also been improved over that shown in this prior patent in a variety of ways. Previously, the vise (or gripping) members of the clamp were made of aluminum. The fingers 15 extending from the top of the vise members were subject to slight deformation if the clamp was overtightened due to misuse, resulting in the yield strength of the aluminum fingers being exceeded. Such deformation may cause permanent warping of the clamp plate or fingers, possibly resulting in slipping of the strings or the application of an increased clamping force. In the improved clamp assembly 11, the vise members or clamp plates as well as fingers are preferably made from a material having a high yield strength, which in the preferred embodiment is greater than 45 KSI to minimize deformation of fingers 15. A suitable material is an aluminum/zinc alloy, such as ZA 27 produced by Alloy Die Casting Co. The zinc alloy is a stiffer material which will provide a very solid and secure clamping action on the string. The fingers 15 will deflect less to maintain proper clamping action at lower clamping forces. The example of an appropriate zinc alloy given above has been found to be 10% stiffer than the aluminum alloy previously used. The zinc alloy also has been found to have a 124% higher yield strength, such that overtightening of the clamp will not permanently warp the clamp plate or fingers. The zinc alloy has also been found to be 38% harder to contribute to longer clamp life and provide a better bearing surface. This material will thus reduce wear caused by friction against the glide bar upon movement of the clamp plates.

Figure 3:
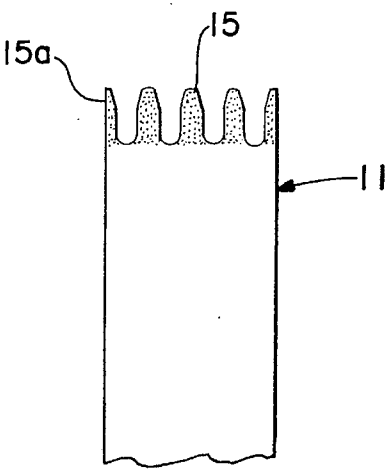
FIG. 3 is an enlarged partial view of a clamp plate and fingers of the apparatus.

Also as shown in FIG. 3, the fingers 15 are provided with a textured bearing surface 15*a* in the preferred embodiment, which further promotes retention of a string therein. The textured surface 15*a* may be formed by any appropriate method, such as in molding or casting of the fingers 15 in the clamp plate, by sandblasting, or other suitable technique. It is also possible to provide a coating on the fingers 15 which would act as a textured bearing surface in a similar manner. The roughened bearing surface 15*a* functions appropriately due to the higher yield strength and other characteristics of the material from which the clamp plate and fingers are made as described above.

The stringing machine 10 further includes a fairing 21 situated about the tension-head assembly 8. The fairing 21 reduces the possibility of the string hanging up on a portion of the machine 10 during stringing. The fairing 21 facilitates more reliable and quicker stringing, even by those with little experience. The fairing 21 also covers various adjustments of machine 10 which may accidentally be moved during setup or use resulting in misstringing of a racquet. The machine 10 is thus tamper-proof and prevents possible damage to a racquet or to tension head assembly 8.

In operation, a racquet to be strung is secured within the machine 10 by means of the tip riser assembly 12 and throat riser assembly 13. The throat riser assembly is locked into a fixed position by locking lever 14 which pivots horizontally as seen in FIG. 2. Lever 14 is shown in FIG. 2 in the locked position, and is in the unlocked position when moved in a clockwise direction as shown by the arrow. Upon fastening of the racquet head within the machine 10, the clamp assembly 11 is moved into place via the glide bar assembly 17 and glide bar supporting frame 19. The clamp 11 will be fastened to the racquet strings on its distal end. The tension head assembly 8 is thereafter used to place tension on the strings during the stringing process. In the stringing process, the clamp 11 is tightened on a string adjacent a racquet frame, to allow the free end of the string to be passed through the tension head assembly 8. The tension head assembly 8 will then apply the desired tension on the string, after which the clamp 11 may be moved to the unclamped end of the string to retain tension in the string. The racquet and table 9 may then be rotated and a second string is tensioned by means of the tension head assembly 8. The clamp assembly 11 is again used to maintain tension in the string and the process is repeated until all strings have been appropriately tensioned.

Figure 4:
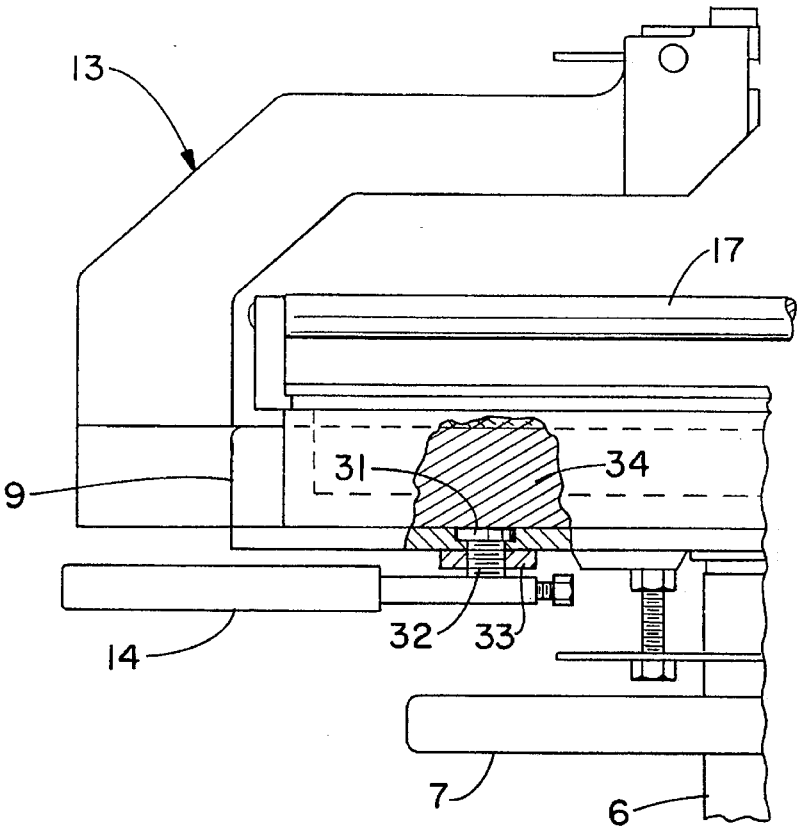
FIG. 4 is an enlarged partial side elevation in partial cross-section, showing the throat riser assembly and the clamping means therefor.

FIG. 4 is an enlarged partial sectional view showing in more detail the throat riser assembly 13. To facilitate securing any type of racquet in machine 10, the throat riser assembly 13 is movable horizontally as indicated in ghost in FIG. 1, and is temporarily locked at a desired position by locking lever 14. The throat riser assembly 13 includes an arm or bar 34, which is slidably engaged in an internal channel within table 9 to allow the horizontal adjustment. A means to selectively lock or secure the position of arm 34 relative to table 9 is provided in association with lever 14. In a preferred embodiment, the locking lever 14 is attached to a threaded screw-like member 32 and the latter is threadably engaged with nut-like member 33 permanently attached to table 9. A friction disc 31 may be positioned between threaded member 32 and bar 34. The disc 31 may have a serrated surface to facilitate frictional engagement between these members. Fixing the throat riser assembly in a desired position is achieved by pressure applied to disc 31 and thus arm 34 by rotation of lever 14.

Figure 5:
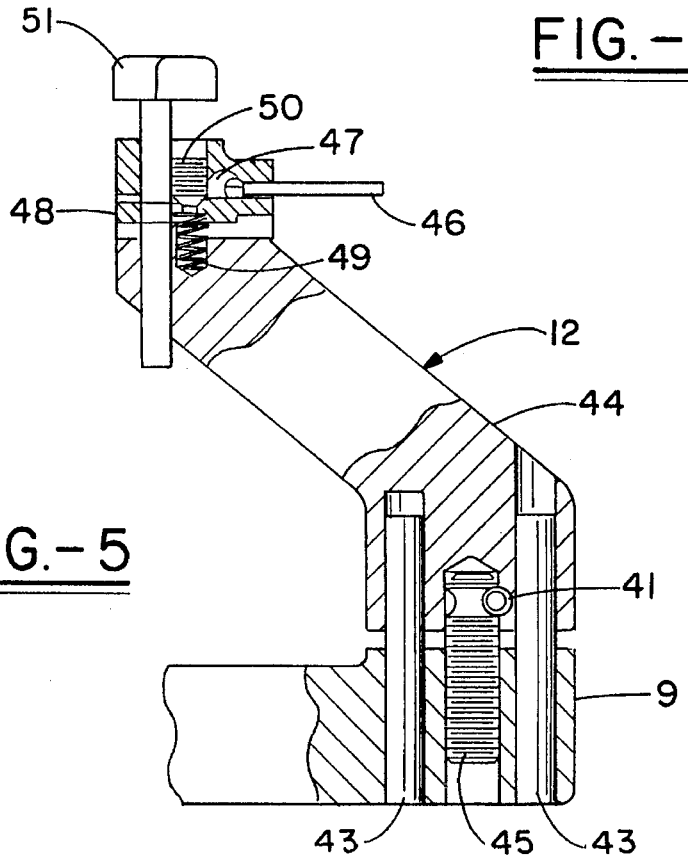
FIG. 5 is a partial side elevation of the tip riser assembly in partial cross-section, with emphasis on the vertical adjustment feature.

FIG. 5 is an enlarged sectional view of tip riser assembly 12. The tip riser assembly 12 includes a set screw 45 which is secured to a base 9. Dowel rods 43 may be used for alignment of the tip riser body 44. On the tip riser body 44, a cam arrangement including a shaft 46 having a cam portion 47 thereon is provided for frictionally engaging and holding a racquet. A dog 48 is secured within a slot formed in the front section of tip riser body 44 in association with a spring 49 and set screw 50 which is threadably engaged in an aperture along the axis of the spring 49 and through an aperture within dog 48. A racquet clamp member 51 is used to hold the racquet tip in position for restringing. The working height of the tip riser is vertically adjustable. Adjustment of the working height of the tip riser is made by adjustment screw 45 which raises and lowers member 44 with respect to table 9. The adjustment screw 45 further cooperates with a roll pin 41 which is fixed in a slot formed within screw 45 and member 44. The roll pin 41 retains screw 45 in association with body 44 in association with body 44 during adjustment. Various aspects of the clamping mechanism and operation of the tip riser assembly 12 may be had by reference to U.S. Pat. No. 4,546,977 which is incorporated herein by reference.

Figure 6:
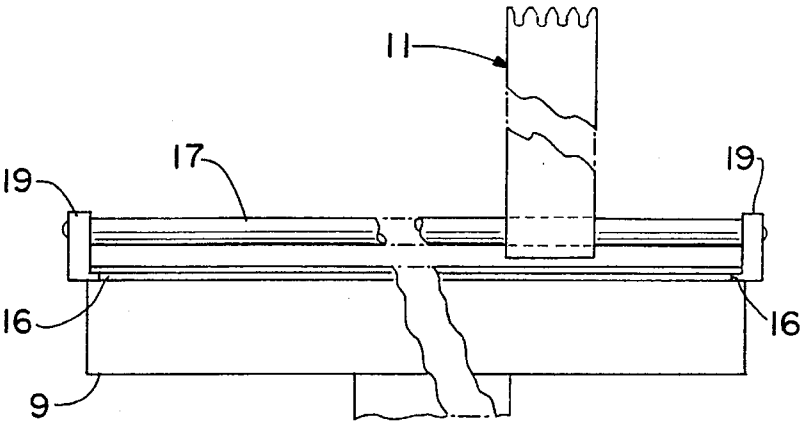
FIG. 6 is a partial side elevational view of the table showing the machined groove in which the glide bar travels.

Further details of the glide bar assembly 17 and its supporting frame 19 are shown in FIG. 6. The glide bar assembly 17 and frame 19 are movably retained in association with table 9 by means of grooves 16 formed therein. It is to be noted that the groove 16 preferably extends around the entire periphery of the table 9. Thus, the glide bar assembly can be engaged with either pair of grooves on opposite sides of the table. Table 9 is of sufficient length and width to eliminate the need for glide bar extensions, thus providing greater stability for the glide bar 17 and string clamp 11 mounted thereon.

Figure 7:
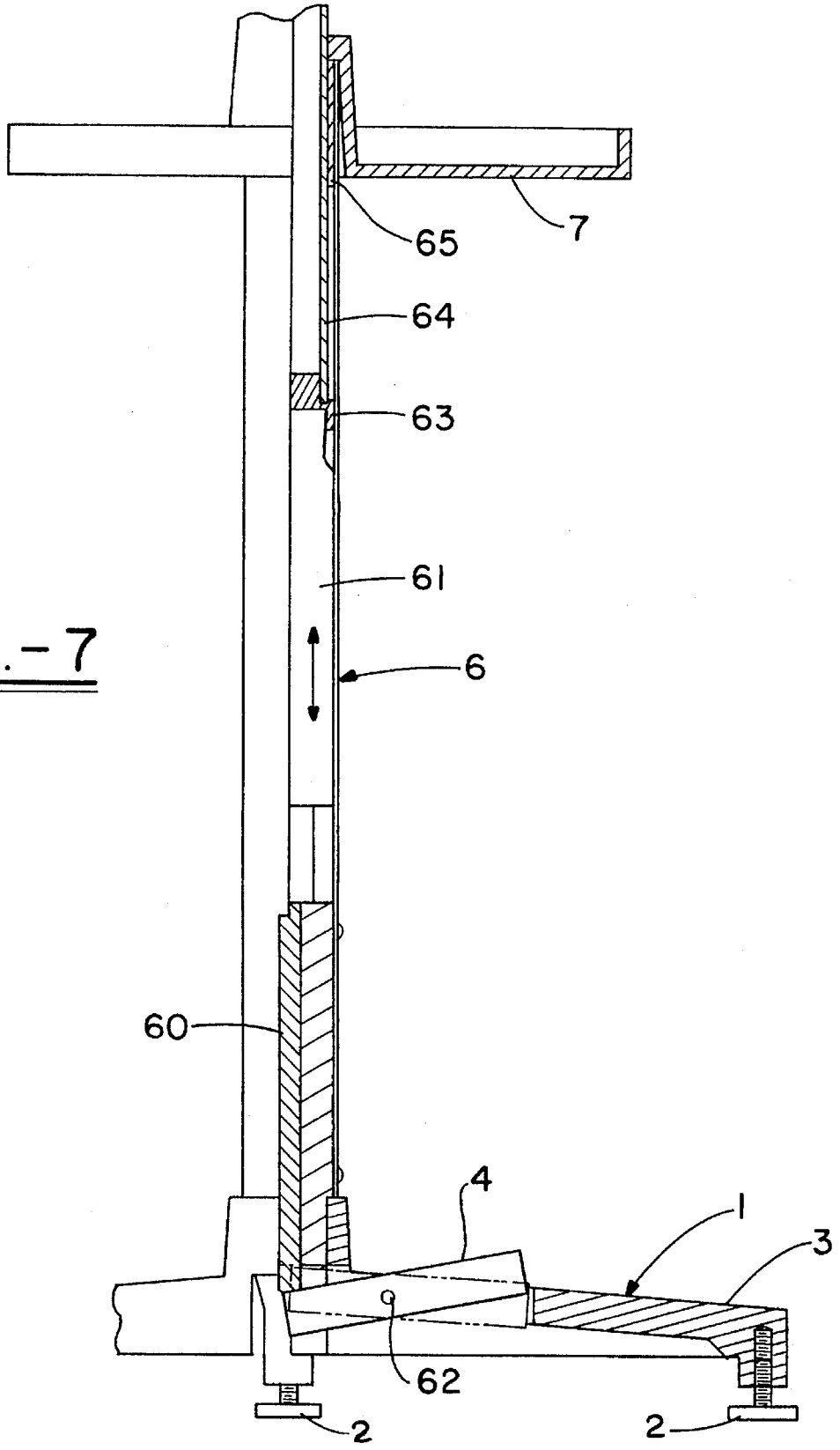
FIG. 7 is a vertical sectional view of the base and column showing the gas spring used for adjusting the vertical height of the functional components of the stringing machine.

As previously mentioned, the height of table 9 can also be easily adjusted. FIG. 7 is a partial sectional view of column 6 and base 1 of stringing machine 10 showing details of preferred embodiment of the mechanism used to adjust the height of the table 9 and accessory equipment. The adjustment mechanism includes a gas spring 61 to raise and lower the working height of table 9. Gas spring 61 is activated by a foot-operated pedal 4, which pivots about point 62 to move push rod 60. To raise the working height, the compressed gas spring 61 has an outwardly extending piston which is mechanically released by means of the push rod 60 to push upward on member 63 and 64 relative to a stationary bushing 65 secured to column 6. This assembly will raise the tool tray 7, tension head 8, and table 9 to a desired height, and will keep these members at a constant distance from each other. The working height is lowered by depressing foot pedal 4 and allowing the weight of the tool tray 7, tension head assembly 8 and table 9 to compress the gas spring. Alternatively, downward pressure on the table with the hand will lower the working height.

Figure 8:
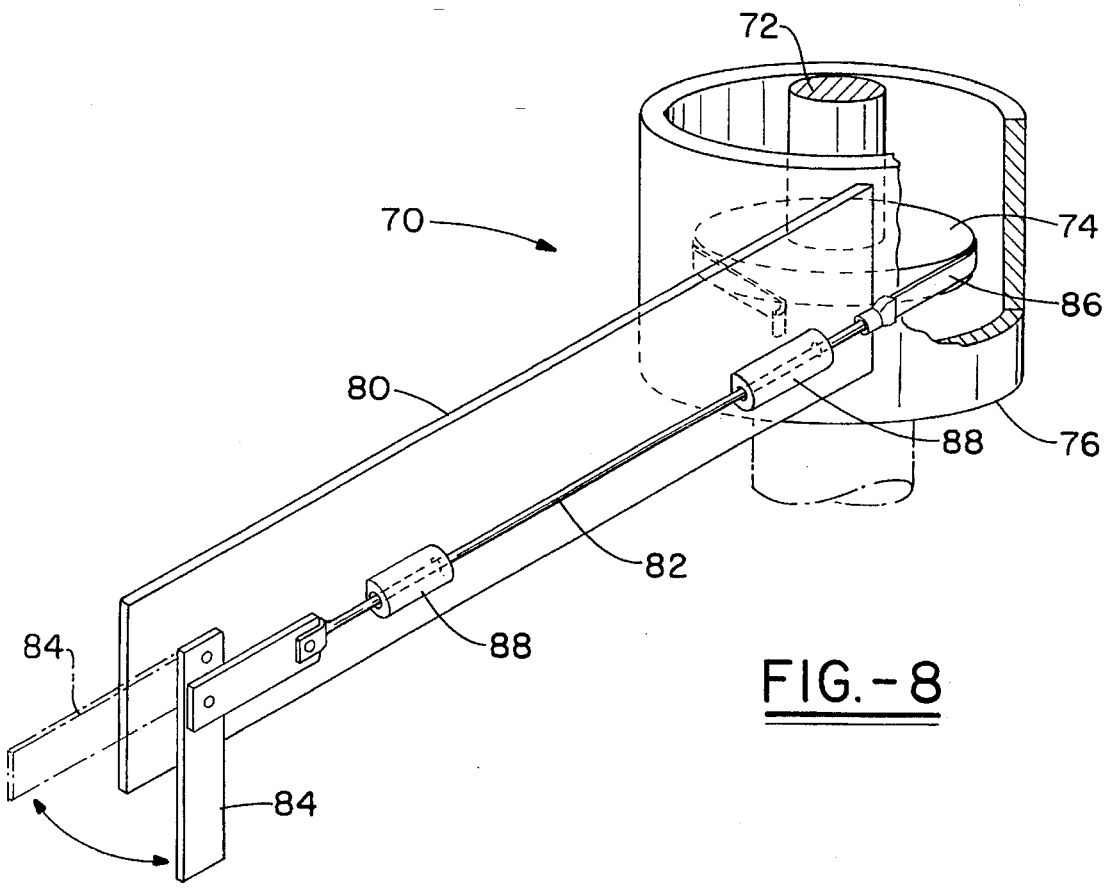
FIG. 8 is a partial perspective view of an optional brake assembly for the apparatus.

Turning now to FIG. 8, a optional brake assembly for use with machine 10 will be described. In use of the stringing machine 10, the position of the table 9 and associated tension head assembly 8 are selectively varied to facilitate threading and tensioning strings during the stringing process. A simple brake mechanism may be used to selectively lock table 9 during the stringing process at a desired position. The brake assembly generally designated 70 operates in association with the stem 72 which is secured to table 9 of the stringing machine. The stem 72 carries a disc 74 in a fixed position thereon. The disc 74 is preferably encompassed within a housing 76 to prevent the snagging of a string on any of the brake components. This assembly is mounted on the tension arm tube 78 which is mounted within the column assembly 6 of the stringing machine 10. The arrangement of the stem 72, disc 74, housing 76, and tension arm tube 78 rotate with respect to the column assembly 6 as previously noted. For actuation of the brake assembly 70, a tension arm 80 extends outwardly from housing 76 so as to be easily accessible by the user. The tension arm carries a pull rod 82 which is coupled at one end to an actuating lever 84, and at its other end to a friction member or band 86. The band 86 extends through apertures within housing 76 and is wrapped around the disc 74. The pull rod 82 is slidably mounted between bushings 88, such that upon movement of lever 84, the rod 82 will be moved toward or away from band 86. In this manner, movement of lever 84 will cause tightening or loosening of the band 86, with brake action being applied by friction between the band 86 and disc 74 as tension is applied via pull rod 82. As shown in FIG. 8, the actuating lever 84 will lock the position of table 9 when in the position as shown in ghost, or will release the table 9 for rotation to any desired position, after which the brake may be reset to fixed position of table 9. Although this provides an example of a suitable brake mechanism for use with machine 10, various other alternatives would occur to those skilled in the art, and are contemplated in the invention. The optional brake mechanism 70 may be used to prevent unwanted motion of table 9 during a stringing process.

In compliance with the statue, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed is:

1. A racquet stringing machine comprising:

a base and column assembly on which a work table is mounted;

a glide bar assembly mounted on said table and having string clamp means slidably positioned thereon;

a tension head assembly for applying tension to a string during stringing of a racquet;

means for securing a racquet in association with said table including a throat riser assembly and a vertically adjustable tip riser assembly, each having racquet clamp means for securing a portion of a racquet frame therein, wherein said throat riser assembly and said tip riser assembly together accommodate different sized or shaped racquet frames.

2. The machine as in claim 1, wherein, the tip riser assembly includes a body member movably coupled to said table by an adjustment screw to effect vertical adjustment of said body member relative to said table and to hold the assembly in a desired fixed position.

3. The machine as in claim 1, further comprising, a groove machined into said table, wherein the glide bar assembly is slidably engaged within said groove.

4. The machine as in claim 1, further comprising, means for adjusting the vertical height of said table relative to the base and column assembly.

5. The machine as in claim 4, wherein, said means for adjusting the vertical height includes a gas spring actuated by a foot-operated lever.

6. The machine as in claim 1, wherein, said string clamp means is formed from a material having a yield strength greater than 45 KSI.

7. The machine as in claim 1, further comprising, a brake means coupled between said table and said column assembly to selectively fix the position of the said table relative to said column assembly.

8. The machine as in claim 1, wherein, said throat riser assembly includes an arm which is slidable within a channel formed in said table and means for securing said arm to fix the position of said arm within said channel.

9. The machine of claim 8, wherein, said means for securing is a friction plate which is forced against said arm to prevent movement thereof.

10. The machine as in claim 9, wherein, said friction plate has a serrated surface to facilitate frictional engagement with said arm.

11. The machine of claim 1, further comprising;

a fairing enclosing said tension head to prevent strings from snagging on portions of said machine.

12. A racquet stringing machine comprising:

a base assembly on which is mounted a table;

a glide bar assembly mounted on said table and having a clamp means slidably positioned thereon for clamping a string therein;

means for securing a racquet frame on said table, said table having a continuous groove formed integrally therein around the peripheral edge of said table, wherein said glide bar assembly includes a frame cooperating on opposed sides of said table with said groove to allow the position of said glide bar assembly to be adjusted relative to said table.

13. The machine of claim 12, wherein, said glide bar assembly frame has portions which extend into said groove to be slidably retained therein.

14. The machine of claim 12, wherein, said groove is formed about the entire periphery of said table.

15. A racquet stringing machine comprising:

a base and a work table supported on said base, said work table having a channel formed therein;

clamp means movably positioned on said table to clamp a string therein;

a tension head assembly for applying tension to a string during stringing of a racquet; and means for securing a racquet in association with said table including a throat riser assembly supported on said table and having means for securing a throat portion of a racquet, and throat riser assembly being horizontally adjustable relative to said table to accommodate different sized racquets, said throat riser assembly having an arm which is slidably engaged with said horizontal channel formed in said table, said arm being selectively held in a desired fixed position by a friction plate which is forced against said arm by a hand operated locking lever to prevent movement thereof.

16. The machine as in claim 15, wherein, said friction plate has a serrated surface to facilitate frictional engagement with said arm.

* * * * *